US007432033B2

(12) United States Patent
Chou et al.

(10) Patent No.: US 7,432,033 B2
(45) Date of Patent: Oct. 7, 2008

(54) PRINTING SYSTEMS AND METHODS FOR LIQUID TONERS COMPRISING DISPERSED TONER PARTICLES

(75) Inventors: Hsin Hsin Chou, Woodbury, MN (US); Brian P. Teschendorf, Vadnais Heights, MN (US); James A. Baker, Hudson, WI (US)

(73) Assignee: Samsung Electronics Co., Ltd., Suwon (KR)

( * ) Notice: Subject to any disclaimer, the term of this patent is extended or adjusted under 35 U.S.C. 154(b) by 447 days.

(21) Appl. No.: 10/978,671

(22) Filed: Oct. 31, 2004

(65) Prior Publication Data

US 2006/0093952 A1 May 4, 2006

(51) Int. Cl.
*G03G 9/12* (2006.01)

(52) U.S. Cl. ..... 430/137.22; 430/114; 399/238

(58) Field of Classification Search ..... 430/116, 430/137.22, 114; 399/238
See application file for complete search history.

(56) References Cited

U.S. PATENT DOCUMENTS 3,411,936 A 11/1968 Roteman
4,413,048 A 11/1983 Landa
4,420,244 A 12/1983 Landa
4,851,316 A * 7/1989 Lu et al. ..... 430/115
4,886,726 A 12/1989 Chan et al.
5,066,559 A * 11/1991 Elmasry et al. ..... 430/115
5,100,471 A * 3/1992 Winnik et al. ..... 523/216
5,176,974 A 1/1993 Till et al.
5,206,108 A 4/1993 Felder et al.
5,254,425 A 10/1993 Suzuki et al.
5,262,259 A 11/1993 Chou et al.
5,304,451 A 4/1994 Felder et al.
5,384,226 A 1/1995 Kanakura et al.
5,420,676 A 5/1995 Arcaro
5,432,591 A 7/1995 Geleynse
5,530,533 A 6/1996 Wallace
5,591,557 A * 1/1997 Lawson et al. ..... 430/115

(Continued)

FOREIGN PATENT DOCUMENTS

CN 1209578 A 3/1999

(Continued)

OTHER PUBLICATIONS

Commonly assigned U.S. Appl. No. 10/978,636, filed Oct. 31, 2004 entitled "Liquid Toners Comprising Amphipathic Copolymeric Binder That Have Been Prepared, Dried and Redispersed in the Same Carrier Liquid", in the name of Chou et al.

(Continued)

*Primary Examiner*—Hoa V Le
(74) *Attorney, Agent, or Firm*—DLA Piper US LLP

(57) ABSTRACT

Methods of printing with a liquid electrophotographic toner composition prepared within an electrophotgraphic printing apparatus are provided, wherein a polymeric binder comprising at least one amphipathic copolymer comprising one or more S material portions and one or more D material portions is first prepared in a reaction solvent, wherein the reaction solvent comprises less than about 10% aromatic components by weight and has a Kauri-Butanol number less than about 30 mL. Toner particles are then formulated in the reaction solvent and dried. The dried toner particles are then redispersed in a carrier liquid.

17 Claims, 2 Drawing Sheets

U.S. PATENT DOCUMENTS

| | | | | |
|---|---|---|---|---|
| 5,713,062 | A | 1/1998 | Goodman et al. | |
| 5,744,269 | A * | 4/1998 | Bhattacharya et al. | 430/18 |
| 5,781,828 | A | 7/1998 | Caruthers, Jr. et al. | |
| 5,886,067 | A * | 3/1999 | Li et al. | 523/201 |
| 5,916,718 | A | 6/1999 | Kellie et al. | |
| 5,918,093 | A | 6/1999 | Kim | |
| 6,136,490 | A | 10/2000 | Ogawa et al. | |
| 6,255,363 | B1 | 7/2001 | Baker et al. | |
| 6,526,244 | B1 | 2/2003 | Viturro et al. | |
| 6,546,221 | B2 | 4/2003 | Baker et al. | |
| 6,647,234 | B2 | 11/2003 | Herman et al. | |
| 6,649,316 | B2 | 11/2003 | Baker et al. | |
| 6,684,045 | B2 | 1/2004 | Viturro et al. | |
| 6,694,113 | B2 | 2/2004 | Park et al. | |
| 7,014,973 | B2 * | 3/2006 | Qian et al. | 430/114 |
| 7,070,900 | B2 * | 7/2006 | Qian et al. | 430/114 |
| 7,074,537 | B2 * | 7/2006 | Qian et al. | 430/114 |
| 7,166,405 | B2 * | 1/2007 | Qian et al. | 430/114 |
| 2002/0197552 | A1 * | 12/2002 | Baker et al. | 430/114 |
| 2003/0134940 | A1 * | 7/2003 | Morrison et al. | 523/160 |
| 2004/0091807 | A1 | 5/2004 | Qian et al. | |
| 2004/0091808 | A1 | 5/2004 | Qian et al. | |
| 2004/0091809 | A1 | 5/2004 | Qian et al. | |

FOREIGN PATENT DOCUMENTS

| | | |
|---|---|---|
| DE | 2826127 | 12/1979 |
| EP | 1422574 | 5/2004 |
| JP | 01113766 | 5/1989 |
| JP | 05-119529 | 5/1993 |

OTHER PUBLICATIONS

Commonly assigned U.S. Appl. No. 10/978,652, filed Oct. 31, 2004 entitled "Liquid Toners Comprising Toner Particles Prepared in a Solvent Other Than the Carrier Liquid", in the name of Chou et al.

* cited by examiner

PRINTING SYSTEMS AND METHODS FOR LIQUID TONERS COMPRISING DISPERSED TONER PARTICLES

TECHNICAL FIELD

The present invention relates to methods and systems using liquid toner materials for use with electrographic processes. More particularly, the invention relates to the use of such methods and systems with liquid toner compositions that are dried to form a dry toner then are subsequently redispersed in a carrier liquid within an electrophotographic printing apparatus.

BACKGROUND OF THE INVENTION

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which can also be referred to as "light" or actinic radiation, may include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The electrostatic bias potential on the developer should also be higher than the potential of the imagewise discharged surface of the photoreceptor so that the toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the toner, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer can be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor after the transfer step is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes can also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

A single-pass electrophotographic process for developing multiple color images is also known and can be referred to as a tandem process. A tandem color imaging process is discussed, for example in U.S. Pat. Nos. 5,916,718 and 5,420,676. In a tandem process, the photoreceptor accepts color from developer stations that are spaced from each other in such a way that only a single pass of the photoreceptor results in application of all of the desired colors thereon.

Another type of process for developing multiple color images is a multi-color, multi-pass electrophotographic printing process. In this type of process, the photoreceptor typically takes the form of a relatively large diameter drum about which two or more development units are arranged, or toners of varying colors may be contained in developing units that are arranged on a moveable sled apparatus so that they can be moved into place as needed to develop a latent electrophotographic image. The number of rotations of the photoreceptor drum generally corresponds to the number of colors developed in a particular image. The multi-color image is generally built up on the photoreceptor in an overlaid configuration, and then the full color image is transferred with each color remaining in imagewise registration, to a final image receptor, either directly or via an intermediate transfer element.

Alternatively, electrophotographic imaging processes can be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a carrier liquid. The carrier liquid is typically a nonconductive dispersant, to avoid discharging the latent electrostatic image. Liquid toner particles are generally solvated to some degree in the carrier liquid (or carrier fluid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the carrier liquid. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227-252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1-1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68-74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3-10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer. U.S. Pat. No. 5, 254,425 discloses a self-dispersing graft-copolymer capable of self-dispersion in a high-electrical insulating carrier liquid to form grains therein. A toner kit is also provided that is composed of a complete solid toner and a carrier liquid. The copolymers as described in this patent are all made in a toluene carrier liquid. There is a need in the art for improved methods and equipment for coating liquid toner compositions that are storage stable and that produce high quality, durable images on a final image receptor.

SUMMARY OF THE INVENTION

The dry toner composition to be used in the process of the present invention is a composition that can readily be dispersed in a carrier liquid for in situ printing. Dispersible dry toners may readily be formulated by practitioners in accordance with the principles as described herein.

In one embodiment, the dry toner composition can comprise dispersing agents incorporated in the composition to facilitate dispersion of toner particles that would otherwise not be dispersible. In an embodiment of this invention, the dispersing agents are not covalently bound to the toner particles. Examples of suitable dispersing agents include rubbers such as styrene-butadiene, vinyltoluene-butadiene or butadiene-isoprene; polymers of acrylic monomers having a long-chain alkyl group, such as 2-ethylhexyl(meth)acrylate, lauryl (meth)acrylate or stearyl(meth)acrylate; and copolymers of these acrylic monomers with other monomers (e.g., styrene, (meth)acrylic acid and the methyl, ethyl or propyl ester thereof).

In another embodiment, the dry toner composition comprises toner particles having dispersion additives ionically bound thereto. In this embodiment, the binder polymer and/or colorant or other component of the toner particle is provided with ionic functionality, and the dispersing agent is provided with an ionic functionality capable of coordinating with the ionic functionality of the toner particle. In this embodiment, the dispersing agent is advantageously strongly associated with the toner particle, thereby further facilitating in the dispersibility of the dry toner composition.

In another embodiment, the dry toner composition comprises a self-dispersing graft-copolymer such as disclosed in U.S. Pat. No. 5, 254,425, incorporated herein by reference. The graft copolymer as described therein is formed by the reaction of a macromonomer having polymerizable functionality with comonomers to form a polymer in the configuration of branches derived from the macromonomer and a stem from the comonomers. The branch component derived from the macromonomer is insoluble in the carrier liquid of the ultimate liquid toner, and the stem portion is soluble in the carrier liquid. Alternatively, the branch component derived from the macromonomer can be insoluble in the carrier liquid of the ultimate liquid toner, and the stem portion can be soluble in the carrier liquid.

In a preferred embodiment, the dry toner composition comprises toner particles having a polymeric binder that comprises at least one amphipathic copolymer comprising one or more S material portions and one or more D material portions. Preferably, the S material portions of the amphipathic copolymer comprise a plurality of anchoring groups, thereby providing an amphipathic copolymer having a plurality of links between the individual S material portions and the D material portions. The structure of the amphipathic copolymer provides a distinct advantage as compared to graft copolymers having on only one link or attachment point between soluble components and insoluble components, because the resulting copolymer is more stable and resistant to stresses that could cause the S material portion and D material portion to separate. Thus, the particle may be exposed to agitation, solvent effects, and physical stresses such as deagglomeration without separation of the S material portion and D material portion from each other.

In the printing process, the dry toner particle composition is dispersed in a carrier liquid that that has a Kauri-Butanol number less than about 30 mL, and otherwise is suitable for use in liquid electrographic processes. In one embodiment, the carrier liquid that is used for redispersion is the same as the reaction solvent. For purposes of the present invention, a carrier liquid is considered to have substantially the same chemical constitution as the reaction solvent if it varies in components in chemical content in minor amounts, such as less than about 10% by weight, and in identity in a manner that does not affect the overall solvent properties (such as polarity, solubility parameter, and so on) of the carrier liquid as compared to the reaction solvent. In another embodiment, the carrier liquid may be different from the reaction solvent.

Because the toner composition is stored and transported in the dry state prior to dispersion in a carrier liquid in the printer, significant advantages are provided. The dry toner particle composition is readily stored with substantially reduced fire hazards, with little or no charge equilibrium change as can be experienced in liquid toners during storage, and with no settling or caking issues that can occur when storing liquid toners in long-term storage. Additionally, the dry toner particle composition take up less space and are less heavy than the corresponding liquid toner compositions, providing further storage and shipping advantages. Additionally, provision of toner in a dry state prior to dispersion provides an opportunity to easily premix dry toners in the manufacturing environment to average out batch variations, thereby providing superior lot-to-lot consistency. In a preferred aspect of the present invention, the dry toner particle compositions are stored as relatively low cost and high stability inventory for periods of greater than 3 weeks after production, and preferably for greater than 2 months after production, prior to dispersion in a liquid carrier to form a liquid toner composition.

One aspect of the present invention includes a method of preparing a liquid electrographic toner composition comprising the steps of: (a) preparing a polymeric binder comprising at least one amphipathic copolymer comprising one or more S material portions and one or more D material portions in a reaction solvent, wherein the reaction solvent comprises less than about 10% aromatic components by weight and has a Kauri-Butanol number less than about 30 mL; (b) formulating toner particles comprising the polymeric binder of step (a) and a visual enhancement additive in the reaction solvent; (c) drying a plurality of toner particles as formulated in step (b) to provide a dry toner particle composition; and (d) redispersing the dry toner particle composition of step c) in a carrier liquid having a Kauri-Butanol number less than about 30 mL to form a liquid electrographic toner composition; wherein the step of redispersing the dry toner particle composition of step (d) is performed within an electrophotographic printing apparatus.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Providing liquid toner in electrophotographic printing processes to produce consistent, high quality prints can present some challenges, including difficulty in providing suitable toner storage conditions that protect the toner quality, particularly over extended storage times. Thus, the present invention provides methods and apparatuses for printing with a dry toner that can readily be dispersed in a carrier liquid for in situ printing, which provides unique benefits that can provide consistent, high quality prints and minimize or eliminate many of the issues surrounding toner storage. More particularly, according to the present invention, the toner composition is stored and transported in a dry state prior to dispersion in a carrier liquid in the printer, which provides significant advantages. First, the dry toner particle composition can be readily stored with substantially reduced fire hazards, with little or no charge equilibrium change as can be experienced in liquid toners during storage, and with no settling or agglomeration issues that can occur when storing liquid toners in long-term storage. Additionally, the dry toner particle composition takes up less space and is less heavy than corresponding liquid toner compositions, providing further storage and shipping advantages. Additionally, provision of toner in a dry state prior to dispersion provides an opportunity to easily premix dry toners in the manufacturing environment to average out batch variations, thereby providing superior lot-to-lot consistency. In a preferred aspect of the present invention, the dry toner particle compositions are stored as relatively low cost and high stability inventory for periods of greater than 3 weeks after production, and preferably for greater than 2 months after production, prior to dispersion in a liquid carrier to form a liquid toner composition.

Figure 1:
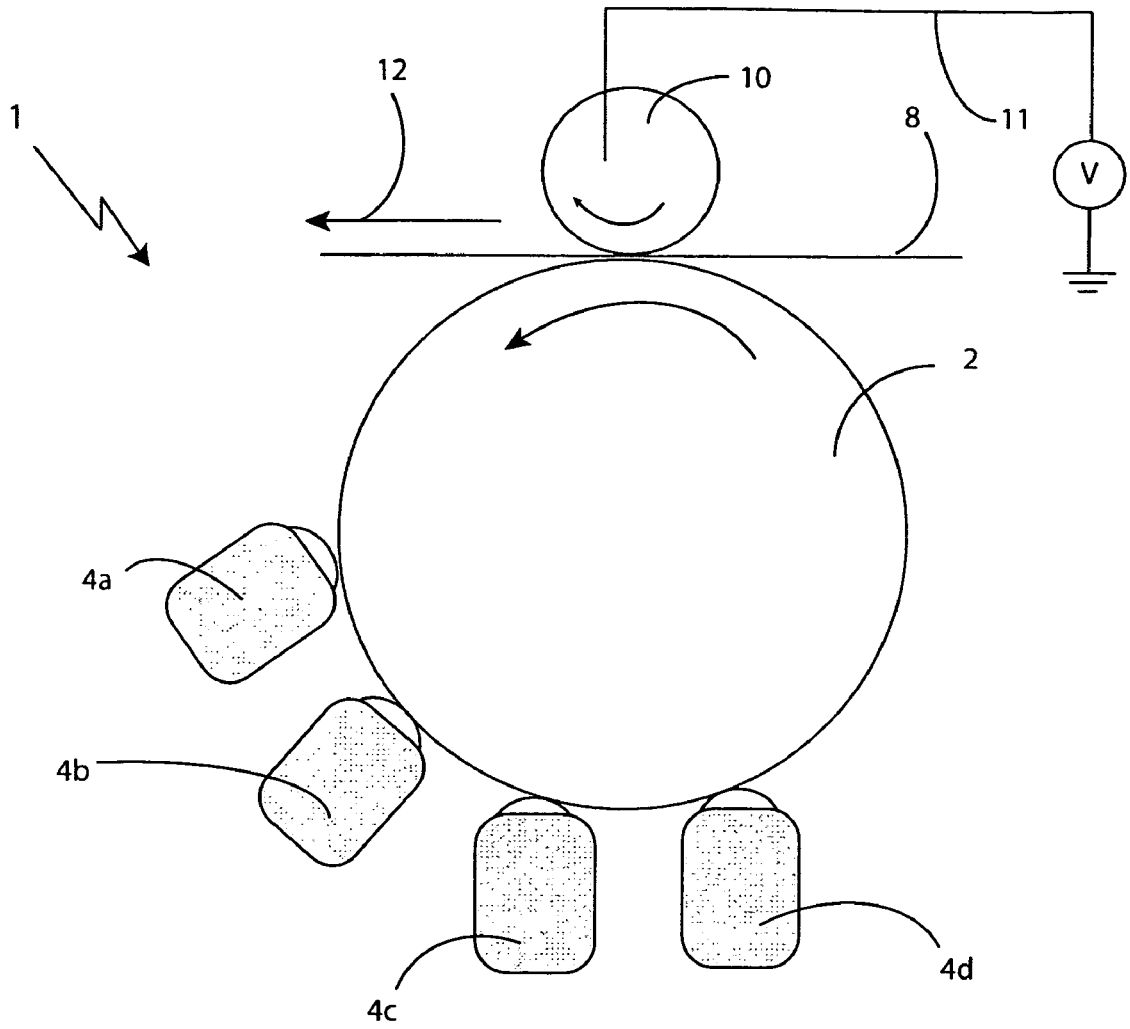
FIG. 1 is a schematic view of a portion of a representative electrophotographic apparatus using a tandem configuration in an electrostatic transfer process, in accordance with the present invention.

The present invention will be further explained with reference to the appended Figures, wherein like structure is referred to by like numerals throughout the multiple views, and wherein FIG. 1 is a schematic drawing of an electrophotographic apparatus 1 using a tandem configuration and process that uses electrostatic transfer with development units and printing methods in accordance with the present invention. A photoreceptor 2 is included in the electrophotographic apparatus 1 and is positioned with multiple development units or stations 4*a,* 4*b,* 4*c,* and 4*d* that are held in place against or adjacent to the photoreceptor 2 throughout the entire printing process. As described herein, the development units or stations may be positioned to be in constant contact with the photoreceptors, or there may instead be a slight gap between the development units or stations and any photoreceptors. If a gap is provided, the electrostatic forces are preferably adjusted to accommodate the additional distance the materials will need to move to transfer to the photoreceptor. When four development units are provided, as in this figure, it is preferable that each of the development units provides pigmented liquid ink material of a different color. The development units of a particular electrophotographic apparatus, which may also be referred to as toner development units, preferably contain the colors cyan (C), magenta (M), yellow (Y), and black (K), but the colors in each development unit may include any colors including, for example, a red (R), green (G), blue (B), and black (K) system, or other variations.

In accordance with the present invention, all or some of the development units within a single printing system may include the mechanisms and capabilities described herein for dispersing toner particles in a carrier liquid within a printer. In cases where some of the development units are not equipped for in situ mixing and printing of a liquid toner composition, the remaining development units in the printer may include any of a wide variety of configurations for providing pigmented liquid ink material for printing images. Further, while four development units are provided in this embodiment, more or less development units may be provided for a particular electrophotographic apparatus, including an apparatus with only a single development unit, which may contain the color black, for example.

The photoreceptor 2 is shown in this non-limiting example as a drum, but may instead be a belt, a sheet, or some other photoreceptor configuration. The development units 4*a*-4*d* preferably each hold a dry toner composition and a carrier liquid in a cartridge design or other configuration in which the dry toner composition can be dispersed, as desired, within a carrier liquid for in situ printing. Alternatively, the development units 4*a*-4*d* may each hold only dry toner until carrier liquid is added mechanically or by hand, for example. Preferred configurations of the development units and their use for in situ printing processes are described in further detail below. In any case, the development units 4*a*-4*d* may include at least one compliant roller that attracts charged pigmented or nonpigmented ink or toner particles (that have been dispersed within a carrier liquid) for application of the charged particles to discharged areas on the photoreceptor, as desired. One such compliant roller that may be provided can be referred to as a development roller, which would typically be rotated within its development unit to ensure even coverage of the liquid toner to the photoreceptor, such as is described for example in U.S. Patent Application No. 2002/0114637, which is incorporated herein by reference. It is understood, however, that the development units used within the processes of the present invention may include a wide variety of different configurations and equipment for transferring ink or transfer assist materials to a photoreceptor.

In the tandem electrophotographic process illustrated in FIG. 1, multiple colors are laid on top of one another in sequence with a single rapid pass of the photoreceptor 2 past the multiple development units. However, it is possible to use multiple development units to place only one color of ink onto the photoreceptor and/or to place clear or tinted layers onto the photoreceptor to provide certain characteristics to the printed image, such as UV stabilization or mold resistance. Once the photoreceptor 2 has received the liquid toner, the composite image may be transferred directly to a final image receptor 8 that is traveling in the direction of arrow 12. A transfer roller 10 is biased as shown by the representation 11 to affect an electrostatic transfer of the entire image from the photoreceptor 2 to the final image receptor 8. Many other alternative printer configurations may also include the in situ mixing of liquid toners in accordance with the invention, such as those systems that include intermediate transfer members, photoreceptive belts, or any other arrangement or equipment that can utilize development units and methods of the type described herein.

Another example of a printing process that may be used in accordance with the present invention for printing images having more than one color can be referred to as an electrophotographic, multi-color, multi-pass printing process. In a multi-pass printing process, the photoreceptor takes the form of a relatively large diameter drum to permit an arrangement of two or more multi-color development units or stations around the circumference perimeter of the photoreceptor. Alternatively, toners of varying colors can be contained in development units that are arranged on a moveable sled such that they can be individually moved into place adjacent to the photoreceptor as needed to develop a latent electrophotographic image. A single rotation of the photoreceptor drum generally corresponds to the development of a single color; four drum rotations and four sled movements are therefore required to develop a four color (e.g. full color) image. The multi-color image is generally built up on the photoreceptor in an overlaid configuration, and then the full color image is transferred with each color remaining in imagewise registration, to a final image receptor, either directly or via an intermediate transfer element.

In an exemplary electrophotographic, four-color, four-pass full color printing process, the steps of photoreceptor charging, exposure, and development are generally performed with each revolution of the photoreceptor drum, while the steps of transfer, fusing, cleaning, and erasure are generally performed once every four revolutions of the photoreceptor. However, multi-color, multi-pass imaging processes are known in which each color plane is transferred from the photoreceptor to an intermediate transfer element on each revolution of the photoreceptor. In these processes, the transfer, cleaning and erasure steps are generally performed upon each revolution of the photoreceptor, and the full-color image is built up on the intermediate transfer element and subsequently transferred from the intermediate transfer element to the final image receptor and fused.

Alternatively, electrophotographic imaging processes may be purely monochromatic. In these systems, there is typically only one pass per page because there is no need to overlay colors on the photoreceptor. Monochromatic processes may, however, include multiple passes where necessary to achieve higher image density or a drier image on the final image receptor, for example, or if it is desired to add other layers of material to the image, such as UV stabilization layers or layers that enhance image durability.

Figure 2:
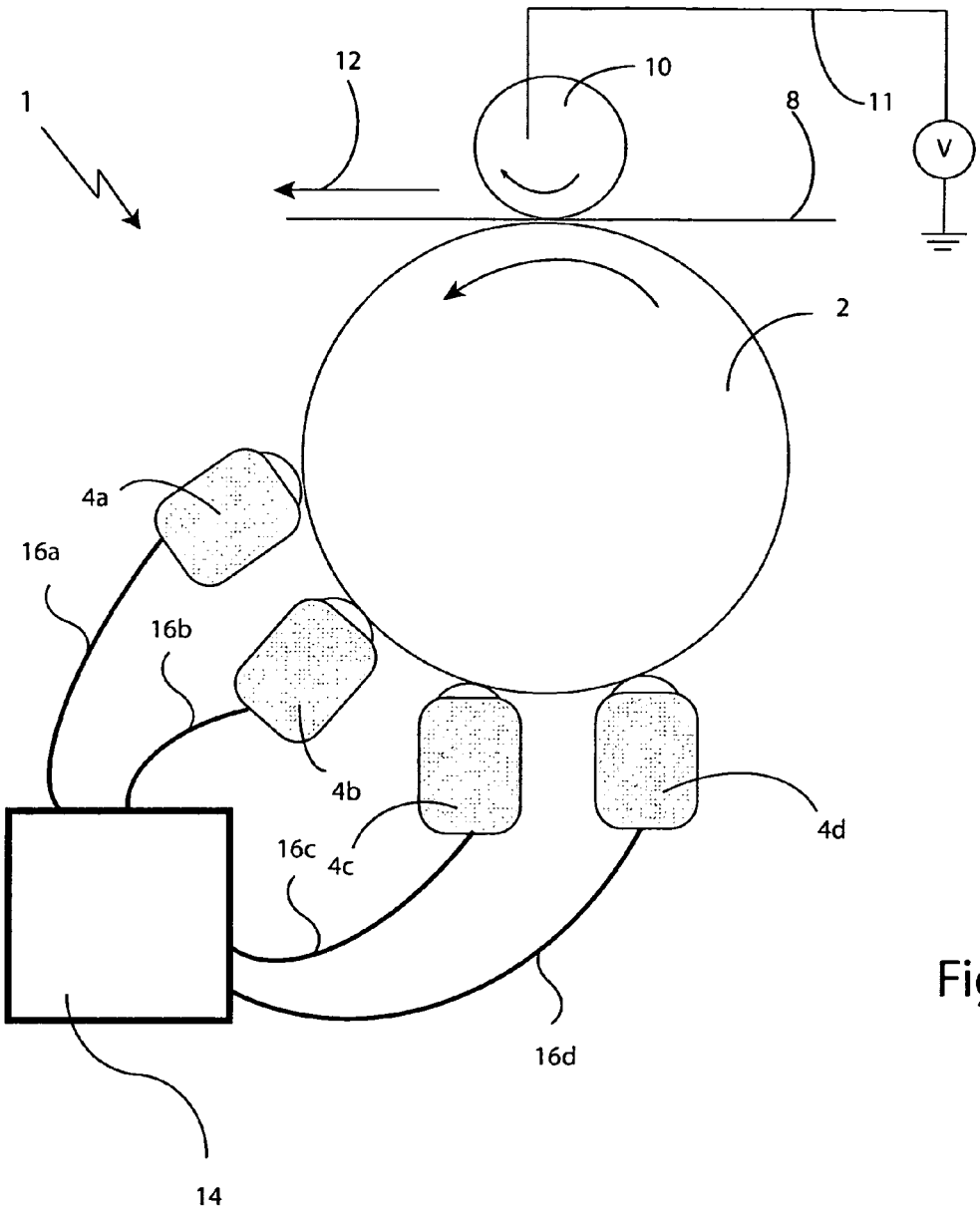
FIG. 2 is schematic view of a portion of an electrophotographic apparatus similar to that of claim 1, further including a liquid carrier supply source.

FIG. 2 is a schematic drawing of an electrophotographic apparatus 1 using a tandem configuration and process that uses electrostatic transfer with development units and printing methods similar to that of FIG. 1. A photoreceptor 2 is included in the electrophotographic apparatus 1 and is positioned with multiple development units or stations 4*a,* 4*b,* 4*c,* and 4*d* that are held in place against or adjacent to the photoreceptor 2 throughout the entire printing process. The apparatus 1 of FIG. 2 further includes a single carrier liquid supply source 14 that is fluidly connected to the developments units 4*a*-4*d* by connecting tubes 16*a*-16*d*, respectively. When four development units are provided, as in this figure, it is preferable that each of the development units provides pigmented liquid ink material of a different color. As explained in further detail below, the supply source 16 preferably contains a carrier liquid, and also preferably contains a sufficient volume of carrier liquid for mixing with the amount of dry toner material provided in each of the development units 4*a*-4*d*. In another embodiment, each of the development units 4*a*-4*d* may have a unique carrier liquid supply source (not shown), similar to the one shown in FIG. 2. Alternatively, two or more development units may share one or more carrier liquid supply sources. As with the embodiment of FIG. 1, while four development units are illustrated in this FIG. 2, more or less development units may be provided for a particular electrophotographic apparatus, including an apparatus with only a single development unit, which may contain the color black, for example.

In accordance with the present invention, the development units 4*a*-4*d* are provided with a dry toner particle composition in a supply container, which will be referred to as a dry toner cartridge herein. Preferably, one dry toner cartridge is inserted or otherwise installed relative to each of the development units 4*a*-4*d* to provide a liquid toner for printing. Each of the dry toner cartridges preferably contains a predetermined quantity of dry toner to meet certain product specifications (e.g., number of images produced with a single cartridge). An appropriate amount of carrier liquid may then be delivered to each of the dry toner cartridges so that the dry toner particle composition within each cartridge is redispersed within that carrier liquid. The carrier liquid may be added to each of the cartridges by a variety of devices and systems for metering controlled amounts of fluids, such as having at least one valve positioned between the supply source 16 and each of the development units 4*a*-4*d*. Alternatively, another cartridge containing a predetermined amount of carrier liquid that corresponds to a certain amount of dry toner material in a dry toner cartridge may be installed within the printing apparatus for mixing with the contents of each of the dry toner cartridges, which may further include tubing and/or valves to control the addition of liquid to the dry toner.

After the dry toner is added to the carrier liquid (or the carrier liquid is added to the dry toner), the two substances are preferably mixed with a device that provides enough mixing to result in redispersion of the toner particles in a carrier liquid, and consequently provide a relatively homogeneous liquid toner. The type of mixer chosen will provide different mixing effects on the liquid toner, such as axial flow, radial flow, high shear mixing, low shear mixing, and the like. The mixing device used may run continuously while the two substances are combined, or may instead only run periodically (such as for the initial mixing of the products, then when sedimentation occurs, for example). For one example, the device containing the dry toner and carrier liquid may be provided with a mixing device including an impeller having a series of blades or paddles that rotate for mixing. For another example, the mixing device may be a screw or auger mechanism that extends along at least a portion of the length of the cartridge in which the mixing takes place. Such a screw mechanism may be designed to rotate at a relatively slow speed to avoid causing high shear on the liquid toner. The container in which the mixing takes place may also be provided with a series of baffles or be otherwise configured to encourage certain fluid flow patterns to occur. For another example, the mixing device may be a magnetic drive mixer. Yet another example of a mixing device is a static mixer which may include a series of fins, obstructions, channels, and the like that promote mixing as carrier liquid and dry toner flow through the mixing device.

In another embodiment of the present invention, each development unit is provided with a cartridge that contains a quantity of the dry toner particle composition and a corresponding quantity of carrier liquid. The toner and liquid are separated from each other, such as with a membrane or other divider that divides the cartridge into two separate chambers. When it is desired to mix the two substances, such as immediately prior to inserting the cartridge into the machine, the separation between the toner and carrier would be modified to allow for either a quick or slow combination of the dry toner with the carrier liquid. For example, a sealing strip material can be a used as divider that need only be pulled, punctured, or otherwise damaged by the user to allow the liquid carrier and dry toner material to combine. Alternatively, a mechanical actuator inside the printer can break a seal or open a baffle to release the dry toner into the liquid carrier. Again, this embodiment may also include any type of mixer that provides for a homogeneous mixture that remains constant for the life of the cartridge.

Any of the mixing apparatuses, but most preferably the mixing apparatuses that include a metering device or other valving system, may optionally be provided with a sensor for monitoring the liquid ink concentration. When the sensor detects a change in the concentration, liquid can be added or withheld until the liquid toner again reaches a desired concentration level.

In another embodiment of the present invention, the dry toner particle composition is transported in a dry state to a location remote from the manufacturing site prior to dispersion in a carrier liquid. Thus, the dry toner particle composition can be packaged in refill quantities and containers for shipping to a distributor or the user for dispersion by a non-manufacturing party in location closer to the site of ultimate use, or at the site of ultimate use of the toner. Shipping of only the dry toner phase of the present toner composition provides advantages in reduction of weight of product to be shipped as a final product, transport and storage condition advantages and reduced flammability hazards.

In yet another embodiment, the dry toner particle composition can be provided together with a carrier liquid as described herein in a two-part kit, with instructions for dispersion of the dry toner with the carrier liquid at or near the site of use of the toner. In a preferred embodiment, the dry toner particle composition and the hydrocarbon carrier liquid are provided in containers that are designed to cooperatively work together to facilitate dispersion of the dry toner particle composition in the carrier liquid. For example, the dry toner particle composition can be packaged in a container specially designed to mate or otherwise connect with the container for the carrier liquid. Alternatively, the dry toner particle composition can be packaged in a container specially designed to provide the appropriate quantity of dry toner particle composition for the predetermined quantity of hydrocarbon carrier liquid as provided in the kit.

In yet another embodiment, the dry toner particle composition can be provided together with the carrier liquid in a three-part kit or cartridge. The dry toner particle composition is provided in a first compartment and the carrier liquid is provided in a second compartment. The dry toner particle compartment may include a toner transport device, such as an auger or screw to move the toner in the compartment. In this embodiment, both compartments are closeably connected to a third compartment that supplies the liquid carrier to the electrographic printing process. Upon receiving a print job in the print buffer of a raster image processor, the processor would determine the amount of liquid toner necessary to print the total number of pixels of a particular toner color and supply the correct proportion of that color of dry toner particle and liquid carrier to the third compartment. The third compartment may optionally include mixing means such as a rotary paddle or blade mixer, an ultrasonic mixer, or a homogenizer, or the dry toner particles may be self-dispersing in the liquid carrier.

Finally, the dry toner particle composition is preferably dispersed in a hydrocarbon carrier liquid that comprises less than about 10% aromatic components by weight and has a Kauri-Butanol number less than about 30 mL, to form a dispersed liquid electrographic toner composition. As noted above, this dispersion can be carried out in the primary manufacturing facility, in a facility that is remote from the manufacturing facility or at the site of the imaging operation.

The preferred dry toner composition used in the methods and systems of the present invention comprises a polymeric binder that comprises an amphipathic copolymer. As used herein, the term "amphipathic" refers to a copolymer having a combination of portions having distinct solubility and dispersibility characteristics in a desired reaction solvent that is used to make the organosol and/or used in the course of preparing the liquid toner particles, and carrier liquid used for formulating the ultimate dispersed toner liquid composition. The reaction solvent that is used as the solvent in the polymerization reaction and as the carrier liquid to form the dispersed liquid electrographic toner composition are both selected such that at least one portion (also referred to herein as S material or portion(s)) of the copolymer is more solvated by the carrier while at least one other portion (also referred to herein as D material or portion(s)) of the copolymer constitutes more of a dispersed phase in the carrier. Preferred amphipathic copolymers are prepared by first preparing an intermediate S material portion comprising reactive functionality by a polymerization process, and subsequently reacting the available reactive functionalities with a graft anchoring compound. The graft anchoring compound comprises a first functionality that can be reacted with the reactive functionality on the intermediate S material portion, and a second functionality that is a polymerizably reactive functionality that can take part in a polymerization reaction. After reaction of the intermediate S material portion with the graft anchoring compound, a polymerization reaction with selected monomers can be carried out in the presence of the S material portion to form a D material portion having one or more S material portions grafted thereto. Preferably, the amphipathic copolymer comprises two or more S material portions. The use of amphipathic copolymers that comprise a plurality of S material portions has been found to provide substantially superior solubility performance.

The resulting polymeric binder is then mixed with necessary additives, such charge directors, visual enhancement additives and the like, to form a toner particles. During such combination, ingredients comprising the additives and the copolymer will tend to self-assemble into composite particles having solvated (S) portions and dispersed (D) portions. For example, it is believed that the D material of the copolymer will tend to physically and/or chemically interact with the surface of the visual enhancement additive, while the S material helps promote dispersion in the carrier.

The reaction solvent and the carrier liquid of the organosol is selected such that at least one portion (also referred to herein as the S material or shell portion) of the amphipathic copolymer is more solvated by the carrier while at least one other portion (also referred to herein as the D material or core portion) of the copolymer constitutes more of a dispersed phase in the carrier. In other words, preferred copolymers of the present invention comprise S and D material having respective solubilities in the desired reaction solvent and the carrier liquid that are sufficiently different from each other such that the S blocks tend to be more solvated by the carrier while the D blocks tend to be more dispersed in the carrier. More preferably, the S blocks are soluble in the reaction solvent and the carrier liquid while the D blocks are insoluble. In particularly preferred embodiments, the D material phase separates from the reaction solvent and the carrier liquid, forming dispersed particles.

From one perspective, the polymer particles when dispersed in the reaction solvent and the carrier liquid can be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the reaction solvent and the carrier liquid. Consequently, the S material can also be referred to herein as a "graft stabilizer." The core/shell structure of the binder particles tends to be retained when the particles are dried when incorporated into liquid toner particles.

The solubility of a material, or a portion of a material such as a copolymeric portion, can be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters,* 2d Ed. CRC Press, Boca Raton, Fla., (1991), for monomers and representative polymers in *Polymer Handbook,* 3rd Ed., J. Brandrup & E. H. Immergut, Eds. John Wiley, N.Y., pp 519-557 (1989), and for many commercially available polymers in Barton, A. F. M., *Handbook of Polymer-Liquid Interaction Parameters and Solubility Parameters,* CRC Press, Boca Raton, Fla., (1990).

The degree of solubility of a material, or portion thereof, in a solvent or a carrier liquid can be predicted from the absolute difference in Hildebrand solubility parameters between the material, or portion thereof, and the solvent or the carrier liquid. A material, or portion thereof, will be fully soluble or at least in a highly solvated state when the absolute difference in Hildebrand solubility parameter between the material, or portion thereof, and the solvent or carrier liquid is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the solvent or carrier liquid, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the solvent or carrier liquid.

Consequently, in preferred embodiments, the absolute difference between the respective Hildebrand solubility parameters of the S material portion(s) of the copolymer and the solvent or carrier liquid is less than 3.0 $MPa^{1/2}$. In a preferred embodiment of the present invention, the absolute difference between the respective Hildebrand solubility parameters of the S material portion(s) of the copolymer and the solvent or carrier liquid is from about 2 to about 3.0 $MPa^{1/2}$. In a particularly preferred embodiment of the present invention, the absolute difference between the respective Hildebrand solubility parameters of the S material portion(s) of the copolymer and the solvent or carrier liquid is from about 2.5 to about 3.0 $MPa^{1/2}$. Additionally, it is also preferred that the absolute difference between the respective Hildebrand solubility parameters of the D material portion(s) of the copolymer and the solvent or carrier liquid is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D material portion(s) is at least about 0.4 $MPa^{1/2}$, more preferably at least about 1.0 $MPa^{1/2}$. Because the solubility of a material can vary with changes in temperature, such solubility parameters are preferably determined at a desired reference temperature such as at 25° C.

Those skilled in the art understand that the Hildebrand solubility parameter for a copolymer, or portion thereof, can be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters,* CRC Press, Boca Raton, p 12 (1990). The magnitude of the Hildebrand solubility parameter for polymeric materials is also known to be weakly dependent upon the weight average molecular weight of the polymer, as noted in Barton, pp 446-448. Thus, there will be a preferred molecular weight range for a given polymer or portion thereof in order to achieve desired solvating or dispersing characteristics. Similarly, the Hildebrand solubility parameter for a mixture can be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the *Polymer Handbook,* 3rd Ed., J. Brandrup & E. H. Immergut, Eds. John Wiley, New York, (1989). We have chosen this method for defining our invention to avoid ambiguities that could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrographic toner and the Hildebrand solubility parameters and glass transition temperatures (based on their high molecular weight homopolymers) for some common monomers used in synthesizing organosols.

TABLE I

| Hildebrand Solubility Parameters Solvent Values at 25° C. | | |
|---|---|---|
| Solvent Name | Kauri-Butanol Number by ASTM Method D1133-54T (ml) | Hildebrand Solubility Parameter ($MPa^{1/2}$) |
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

| Monomer Values at 25° C. | | |
|---|---|---|
| Monomer Name | Hildebrand Solubility Parameter ($MPa^{1/2}$) | Glass Transition Temperature (° C.)* |
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (28 m.p.)** |
| n-Octadecyl Acrylate | 16.82 | −55 (42 m.p.)** |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209–277 (1989). The $T_g$ listed is for the homopolymer of the respective monomer.
**m.p. refers to melting point for selected Polymerizable Crystallizable Compounds.

The reaction solvent is selected from substantially nonaqueous, hydrocarbon solvents or solvent blends, comprising less than about 10% aromatic components. In other words, only a minor component (generally less than 25 weight percent) of the solvent or carrier liquid comprises water. Preferably, the substantially nonaqueous solvent comprises less than 20 weight percent water, more preferably less than 10 weight percent water, even more preferably less than 3 weight percent water, most preferably less than one weight percent water. It has been found that incorporation of aromatic components in the reaction solvent or the carrier liquid adversely affects the imaging properties of the ultimate toner composition.

The substantially nonaqueous reaction solvent can be selected from a wide variety of materials, or combination of materials, which are known in the art, but preferably has a Kauri-butanol number less than 30 ml. The reaction solvent is preferably chemically stable under a variety of conditions. If a "plating drying" method, such as the one used in the Examples of the present invention, is used, it is necessary for the reaction solvent to be electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of reaction solvents are typically greater than $10^9$ Ohm-cm; more preferably greater than $10^{10}$ Ohm-cm. In addition, the reaction solvent desirably is chemically inert in most embodiments with respect to the ingredients used to formulate the toner particles. If the liquid toner is not to be dried via a plating means, it may not be necessary for the reaction solvent to be electrically insulative.

Examples of suitable liquids for use as a reaction solvent in the polymerization reaction include aliphatic hydrocarbons (n-pentane, hexane, heptane and the like), cycloaliphatic hydrocarbons (cyclopentane, cyclohexane and the like), halogenated hydrocarbon solvents (chlorinated alkanes, fluorinated alkanes, chlorofluorocarbons and the like), alkane hydrocarbons ranging from $C_5$ to $C_{13}$, branched paraffinic solvent blends such as Isopar™ G, Isopar™ H, Isopar™ K, and Isopar™ L (available from Exxon Corporation, NJ), aliphatic hydrocarbon solvent blends such as Norpar™ 12 and Norpar™ 13 (available from Exxon Corporation, NJ), and blends of these solvents. Particularly preferred reaction solvents have a Hildebrand solubility parameter of from about 13 to about 15 $MPa^{1/2}$. Preferred reaction solvents are relatively low boiling solvents (i.e having a boiling point preferably below about 200° C., more preferably below about 150° C., and most preferably below about 100° C.), which is particularly advantageous for drying of the toner particles prior to redispersion. Examples of preferred reaction solvents include n-pentane, n-hexane, n-heptane, cyclopentane, cyclohexane and mixtures thereof.

The substantially nonaqueous carrier liquid can be selected from a wide variety of materials, or combination of materials, which are known in the art, but preferably has a Kauri-butanol number less than 30 ml. The carrier liquid is preferably chemically stable under a variety of conditions and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the carrier liquid desirably is chemically inert in most embodiments with respect to the ingredients used to formulate the toner particles.

Examples of suitable carrier liquids for use in the redispersed toner liquid composition include silicone fluids, synthetic hydrocarbons, and fluorocarbon fluids. More specific examples of suitable carrier liquids include aliphatic hydrocarbons (n-pentane, hexane, heptane and the like), cycloaliphatic hydrocarbons (cyclopentane, cyclohexane and the like), halogenated hydrocarbon solvents (chlorinated alkanes, fluorinated alkanes, chlorofluorocarbons and the like), alkane hydrocarbons ranging from $C_5$ to $C_{15}$, and blends of these solvents. Preferred carrier liquids include branched paraffinic solvent blends such as Isopar™ G, Isopar™ H, Isopar™ K, Isopar™ L, Isopar™ M, and Isopar™ V (available from Exxon Corporation, NJ), and most preferred carriers are the aliphatic hydrocarbon solvent blends such as Norpar™ 12, Norpar™ 13, and Norpar™ 15 (available from Exxon Corporation, NJ). Particularly preferred carrier liquids have a Hildebrand solubility parameter of from about 13 to about 15 $MPa^{1/2}$. Examples of preferred carrier liquids include DC-200® silicone fluid (available from Dow Corning™ Co., Midland, Mich.), Eurosupreme™ Synthetic Dielectric Fluid (available from Commonwealth Oil, Ontario, Canada), and FC-40 and FC43 Fluorinert™ Electronic Liquid (available from Minnesota Mining and Manufacturing Co., St. Paul, Minn.).

The carrier liquids of the present invention have a normal boiling point preferably above about 150° C., more preferably above about 200° C., and most preferably above about 240° C. High boiling point carrier liquids tend to provide environmental and flammability benefits, such as through the reduction of harmful airborne chemicals and vapors, or volatile organic compounds (VOC's). The World Health Organization definition of VOCs includes all organic compounds (substances made up of predominantly carbon and hydrogen) with boiling temperatures in the range of 20-260° C., excluding pesticides. This means that they are likely to be present as a vapor or gas in normal ambient temperatures. People are exposed to the VOC's by breathing the contaminated air. The health effects depend on the specific composition of the VOC's present, the concentration, and the length of exposure. High concentrations of some compounds could have serious health effects. General effects include eye, nose and throat irritation, headaches, loss of coordination, nausea, damage to the liver, kidneys and central nervous system and some are suspected or known to cause cancer in humans. Preferred carrier liquids should have higher flashpoints (i.e., preferably above about 60° C. (140° F.), more preferably above about 93° C. (200° F.), and most preferably above about 93° C. (200° F.)), which is beneficial because they are less likely to cause fires or explosions during printer operation. Specific examples of such toner particle compositions and systems are described in commonly assigned copending application [Docket No. SAM0055/US] titled "LIQUID TONERS COMPRISING TONER PARTICLES PREPARED IN A SOLVENT OTHER THAN THE CARRIER LIQUID," filed on even date with the present application.

In a preferred embodiment of the present invention, the dry toner particle composition is redispersed in a carrier liquid having substantially the same chemical constitution as the reaction solvent to form a redispersed liquid electrographic toner composition. For purposes of the present invention, a carrier liquid is considered to have substantially the same chemical constitution as the reaction solvent if it varies in components in chemical content in minor amounts, such as less than about 10% by weight, and in identity in a manner that does not affect the overall solvent properties (such as polarity, solubility parameter, and so on) of the carrier liquid as compared to the reaction solvent. Preferably, the reaction solvent is a hydrocarbon solvent.

Because substantially the same solvent is used as the reaction solvent and the carrier liquid, the toner particle composition can be readily formulated to provide exceptionally easy redispersion of the dry toner composition in the carrier liquid. Further, since the same solvent is used, all components as provided in the reaction solvent will have exactly the same and predictable compatibilities with the carrier liquid. In this embodiment, the reaction liquid chosen for the polymerization reaction should be carefully selected so that the same liquid may be used as the carrier liquid for the redispersed liquid toner. This is beneficial because the dried toner is easily redispersible in the original solvent. Therefore, because the carrier liquid/reaction solvent will be used in an end product, the flashpoint of the carrier liquid/reaction solvent is preferably above about 150° F. and more preferably above about 200° F. Specific examples of such toner particle compositions and systems are described in commonly assigned copending application [Docket No. SAM0054/US] titled "LIQUID TONERS COMPRISING AMPHIPATHIC COPOLYMERIC BINDER THAT HAVE BEEN PREPARED, DRIED AND REDISPERSED IN THE SAME CARRIER LIQUID," filed on even date with the present application.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The weight average molecular weight of the amphipathic copolymer of the present invention can vary over a wide range, and can impact imaging performance. The polydispersity of the copolymer also can impact imaging and transfer performance of the resultant liquid toner material. Because of the difficulty of measuring molecular weight for an amphipathic copolymer, the particle size of the dispersed copolymer (organosol) can instead be correlated to imaging and transfer performance of the resultant liquid toner material. Generally, the volume mean particle diameter ($D_v$) of the dispersed graft copolymer particles, determined by laser diffraction particle size measurement, should be in the range 1-100 microns, more preferably 5-75 microns, even more preferably 10-50 microns, and most preferably 20-30 microns.

In addition, a correlation exists between the molecular weight of the solvatable or soluble S material portion of the graft copolymer, and the imaging and transfer performance of the resultant toner. Generally, the S material portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S material portion of the copolymer below 15, more preferably below 5, most preferably below 2.5. It is a distinct advantage of the present invention that copolymer particles with such lower polydispersity characteristics for the S material portion are easily made in accordance with the practices described herein.

The relative amounts of S and D material portions in a copolymer can impact the solvating and dispersibility characteristics of these portions. For instance, if too little of the S material portion(s) are present, the copolymer can have too little stabilizing effect to sterically-stabilize the organosol with respect to aggregation as might be desired. If too little of the D material portion(s) are present, the small amount of D material can be too soluble in the reaction solvent or the carrier liquid such that there can be insufficient driving force to form a distinct particulate, dispersed phase in the reaction solvent or the carrier liquid. The presence of both a solvated and dispersed phase helps the ingredients of particles self assemble in situ with exceptional uniformity among separate particles. Balancing these concerns, the preferred weight ratio of D material to S material is in the range of 1/20 to 20/1, preferably 1/1 to 15/1, more preferably 2/1 to 10/1, and most preferably 4/1 to 8/1.

Glass transition temperature, $T_g$, refers to the temperature at which a (co)polymer, or portion thereof, changes from a hard, glassy material to a rubbery, or viscous, material, corresponding to a dramatic increase in free volume as the (co) polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54-55 (1992).

In the practice of the present invention, calculated values of $T_g$ for the D or S material portion of the copolymer were determined using the Fox equation above, although the measured $T_g$ of the copolymer as a whole can be determined experimentally using e.g., differential scanning calorimetry. The glass transition temperatures ($T_g$'s) of the S and D material portions can vary over a wide range and can be independently selected to enhance manufacturability and/or performance of the resulting liquid toner particles. The $T_g$'s of the S and D material portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

For copolymers useful in liquid toner applications, the copolymer $T_g$ preferably should not be too low or else receptors printed with the toner can experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking, yet not so high as to require fusing temperatures approaching the temperatures at which the final image receptor can be damaged, e.g. approaching the autoignition temperature of paper used as the final image receptor. Desirably, therefore, the copolymer has a $T_g$ of 0°-100° C., more preferably 20°-90° C., most preferably 40°-80° C.

For copolymers in which the D material portion comprises a major portion of the copolymer, the $T_g$ of the D material portion will dominate the $T_g$ of the copolymer as a whole. For such copolymers useful in liquid toner applications, it is preferred that the $T_g$ of the D material portion fall in the range of 30°-105° C., more preferably 40°-95° C., most preferably 60°-85° C., since the S material portion will generally exhibit a lower $T_g$ than the D material portion, and a higher $T_g$ D material portion is therefore desirable to offset the $T_g$ lowering effect of the S material portion, which can be solvatable. Blocking with respect to the S material portion material is not as significant an issue inasmuch as preferred copolymers comprise a majority of the D material portion material. Consequently, the $T_g$ of the D material portion material will dominate the effective $T_g$ of the copolymer as a whole. However, if the $T_g$ of the S material portion is too low, then the particles might tend to aggregate. On the other hand, if the $T_g$ is too high, then the requisite fusing temperature can be too high. Balancing these concerns, the S material portion material is preferably formulated to have a $T_g$ of at least 0° C., preferably at least 20° C., more preferably at least 40° C.

It is understood that the requirements imposed on the self-fixing characteristics of a liquid toner will depend to a great extent upon the nature of the imaging process. For example, rapid self-fixing of the toner to form a cohesive film may not be required or even desired in an electrographic imaging process if the image is not subsequently transferred to a final receptor, or if the transfer is effected by means (e.g. electrostatic transfer) not requiring a film formed toner on a temporary image receptor (e.g. a photoreceptor). However, where rapid self-fixing of the toner is desired, the calculated glass transition temperature of the D material portion is preferably formulated to be less than 0° C., and more preferably between −25° C. and 0° C.

Similarly, in multi-color (or multi-pass) electrostatic printing wherein a stylus is used to generate a latent electrostatic image directly upon a dielectric receptor that serves as the final toner receptor material, a rapidly self-fixing toner film can be undesirably removed in passing under the stylus. This head scraping can be reduced or eliminated by manipulating the effective glass transition temperature of the organosol. For liquid electrographic (electrostatic) toners, particularly liquid toners developed for use in direct electrostatic printing processes, the D material portion of the organosol is preferably provided with a sufficiently high $T_g$ such that the organosol exhibits an effective glass transition temperature of from about 15° C. to about 55° C., and the D material portion exhibits a $T_g$ calculated using the Fox equation, of about 30-55° C.

In one aspect of the present invention, toner particles are provided that are particularly suitable for electrophotographic processes wherein the transfer of the image from the surface of a photoconductor to an intermediate transfer material or directly to a print medium is carried out without film formation on the photoconductor. In this aspect, the D material preferably has a $T_g$ of at least about 55° C., and more preferably at least about 65° C.

A wide variety of one or more different monomeric, oligomeric and/or polymeric materials can be independently incorporated into the S and D material portions, as desired. Representative examples of suitable materials include free radically polymerized material (also referred to as vinyl copolymers or (meth) acrylic copolymers in some embodiments), polyurethanes, polyester, epoxy, polyamide, polyimide, polysiloxane, fluoropolymer, polysulfone, combinations of these, and the like. Preferred S and D material portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case can be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth) acryl", as used herein, encompasses acryl and/or methacryl.

Free radically polymerizable monomers, oligomers, and/or polymers are advantageously used to form the copolymer in that so many different types are commercially available and can be selected with a wide variety of desired characteristics that help provide one or more desired performance characteristics. Free radically polymerizable monomers, oligomers, and/or monomers suitable in the practice of the present invention can include one or more free radically polymerizable moieties.

Preferred monomers used to form the amphipathic copolymers as described herein are C1 to C24 alkyl esters of acrylic acid and methacrylic acid. Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl(meth)acrylate, nonylphenol ethoxylate(meth)acrylate, N-vinyl pyrrolidone, isononyl(meth)acrylate, isobornyl (meth)acrylate,2-(2-ethoxyethoxy)ethyl(meth)acrylate, 2-ethylhexyl(meth)acrylate, beta-carboxyethyl(meth)acrylate, isobutyl(meth)acrylate, cycloaliphatic epoxide, alpha-epoxide, 2-hydroxyethyl(meth)acrylate, (meth)acrylonitrile, maleic anhydride, itaconic acid, isodecyl(meth)acrylate, lauryl(dodecyl)(meth)acrylate, stearyl(octadecyl)(meth)acrylate, behenyl(meth)acrylate, n-butyl(meth)acrylate, methyl (meth)acrylate, ethyl(meth)acrylate, hexyl(meth)acrylate, (meth)acrylic acid, N-vinylcaprolactam, stearyl(meth)acrylate, hydroxy functional caprolactone ester(meth)acrylate, isooctyl(meth)acrylate, hydroxyethyl(meth)acrylate, hydroxymethyl(meth)acrylate, hydroxypropyl(meth)acrylate, hydroxyisopropyl(meth)acrylate, hydroxybutyl(meth) acrylate, hydroxyisobutyl(meth)acrylate, tetrahydrofurfuryl (meth)acrylate, isobornyl(meth)acrylate, glycidyl(meth) acrylate vinyl acetate, combinations of these, and the like.

Preferred copolymers of the present invention can be formulated with one or more radiation curable monomers or combinations thereof that help the free radically polymerizable compositions and/or resultant cured compositions to satisfy one or more desirable performance criteria. For example, in order to promote hardness and abrasion resistance, a formulator can incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state. The advantages of incorporating such monomers into the copolymer are further described in assignee's co-pending U.S. Patent Application filed in the name of Qian et al., U.S. Ser. No. 10/612,765, filed on Jun. 30, 2003, entitled ORGANOSOL INCLUDING HIGH $T_g$ AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH $T_g$ MONOMER AND LIQUID TONERS FOR ELECTROPHOTOGRAPHIC APPLICATIONS for liquid toner compositions, which are hereby incorporated by reference.

In a preferred embodiment of the present invention, the S material portion comprises radiation curable monomers that have relatively high $T_g$ characteristics. Preferably, such monomers comprise at least one radiation curable (meth) acrylate moiety and at least one nonaromatic, alicyclic and/or nonaromatic heterocyclic moiety. Examples of preferred monomers that can be incorporated into the S material portion comprise isobornyl(meth)acrylate; 1,6-Hexanediol di(meth) acrylate; trimethyl cyclohexyl methacrylate; t-butyl methacrylate; and n-butyl methacrylate. Combinations of high $T_g$ components for use in the S material portion are specifically contemplated, together with anchor grafting groups such as provided by use of HEMA subsequently reacted with TMI.

In certain preferred embodiments, polymerizable crystallizable compounds, e.g. crystalline monomer(s) are incorporated into the copolymer by chemical bonding to the copolymer. The term "crystalline monomer" refers to a monomer whose homopolymeric analog is capable of independently and reversibly crystallizing at or above room temperature (e.g., 22° C.). The term "chemical bonding" refers to a covalent bond or other chemical link between the polymerizable crystallizable compound and one or more of the other constituents of the copolymer. The advantages of incorporating PCC's into the copolymer are further described in assignee's co-pending U.S. Patent Application filed in the name of Qian et al., U.S. Ser. No. 10/612,534, filed on Jun. 30, 2003, entitled ORGANOSOL LIQUID TONER INCLUDING AMPHIPATHIC COPOLYMERIC BINDER HAVING CRYSTALLINE COMPONENT.

In these embodiments, the resulting toner particles can exhibit improved blocking resistance between printed receptors and reduced offset during fusing. If used, one or more of these crystalline monomers can be incorporated into the S and/or D material, but preferably is incorporated into the D material. Suitable crystalline monomers include alkyl(meth) acrylates where the alkyl chain contains more than 13 carbon atoms (e.g. tetradecyl(meth)acrylate, pentadecyl(meth)acrylate, hexadecyl(meth)acrylate, heptadecyl(meth)acrylate, octadecyl(meth)acrylate, etc). Other suitable crystalline monomers whose homopolymers have melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; polymerizable natural waxes with melting points above 22° C., polymerizable synthetic waxes with melting points above 22° C., and other similar type materials known to those skilled in the art. As described herein, incorporation of crystalline monomers in the copolymer provides surprising benefits to the resulting liquid toner particles.

Nitrile functionality can be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth) acrylonitrile, β-cyanoethyl-(meth)acrylate, 2-cyanoethoxyethyl(meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α,β-unsaturated carboxylic acid with a diol, e.g., 2-hydroxyethyl(meth)acrylate, or 2-hydroxypropyl(meth)acrylate; 1,3-dihydroxypropyl-2-(meth) acrylate; 2,3-dihydroxypropyl-1-(meth)acrylate; an adduct of an α, β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

Multifunctional free radically reactive materials can also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri (meth)acrylate, glycerol tri(meth)acrylate, pentaerythritol tri (meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane(meth) acrylates), (meth)acrylated epoxies (i.e., epoxy(meth)acrylates), (meth)acrylated polyesters (i.e., polyester(meth)acrylates), (meth)acrylated(meth)acrylics, (meth)acrylated silicones, (meth)acrylated polyethers (i.e., polyether(meth) acrylates), vinyl(meth)acrylates, and (meth)acrylated oils.

Copolymers of the present invention can be prepared by free-radical polymerization methods known in the art, including but not limited to bulk, solution, and dispersion polymerization methods. The resultant copolymers can have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S material portion or D material portion materials, as the case can be, can be incorporated into the arms and/or the backbone.

Any number of reactions known to those skilled in the art can be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79-106, also incorporated herein by reference.

Representative examples of grafting methods also can use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described above accomplishes grafting via attaching an ethylenically-unsaturated isocyanate (e.g., dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous reaction solvent in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S material portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl(meth)acrylate, ethyl(meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous reaction solvent comprising less than about 10% aromatic components for the organosol. At this stage, it is believed that the copolymer tends to exist in the reaction solvent as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the reaction solvent.

Before further processing, the copolymer particles can remain in the reaction solvent. Alternatively, the particles can be transferred in any suitable way into fresh solvent that is the same or different so long as the copolymer has solvated and dispersed phases in the fresh solvent. In either case, the resulting organosol is then converted into toner particles by mixing the organosol with appropriate additives, such as at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier. In addition to the visual enhancement additive, other additives optionally can be formulated into the liquid toner composition.

The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow 138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

Charge directors can be used in any liquid toner process, and particularly can be used for electrostatic transfer of toner particles or transfer assist materials. The charge director typically provides the desired uniform charge polarity of the toner particles. In other words, the charge director acts to impart an electrical charge of selected polarity onto the toner particles as dispersed in the carrier liquid. Preferably, the charge director is applied to the outside of the binder particle in the reaction solvent, in which case the charge director is preferably soluble in the reaction solvent. Alternatively or additionally, the charge director can be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S material portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive can be adjusted based on a variety of parameters to achieve the desired results for a particular application.

Any number of negative charge directors such as those described in the art can be used in the liquid toners of the present invention in order to impart a negative electrical charge onto the toner particles. For example, the charge director can be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt(e.g., Na) of a phosphoglyceride A preferred example of such a charge director is Emphos™ D70-30C, Witco Chemical Corp., New York. N.Y., which is a sodium salt of phosphated mono- and diglycerides.

Likewise, any number of positive charge directors such as those described in the art can be used in the liquid toners of the present invention in order to impart a positive electrical charge onto the toner particles. For example, the charge director can be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), BI(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps), such as those described in U.S. Pat. No. 3,411,936. A particularly preferred positive charge director is zirconium 2-ethyl hexanoate.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and are seen in the low relationship between current density and toner deposited during development. Low conductivities indicate little or no charging of the toner particles and lead to very low development rates. The use of charge directors matched to adsorption sites on the toner particles is a common practice to ensure sufficient charge associates with each toner particle.

Other additives can also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 1.5 to about 10 microns, most preferably in the range of about 3 to about 5 microns.

The thus created toner particles are dried to provide a dry toner particle composition. For purposes of the present invention, the term "dry" does not mean that the dry toner is totally free of any liquid constituents, but connotes that the toner particles do not contain any significant amount of solvent, e.g., typically less than 20 weight percent solvent, more preferably less than about 10 weight percent solvent, and most preferably less than 5 weight percent solvent. The toner particles can be dried by any desired process, such as, for example, by filtration and subsequent drying of the filtrate by evaporation, optionally assisted with heating. Preferably, this process is carried out in a manner that minimizes agglomeration and/or aggregation of the toner particles into one or more large masses. If such masses form, they can optionally be pulverized or otherwise comminuted in order to obtain dry toner particles of an appropriate size.

Alternative drying configurations can be used, such as by coating the toner dispersed in the reaction solvent onto a drying substrate, such as a moving web. In a preferred embodiment, the coating apparatus includes a coating station at which the liquid toner is coated onto surface of a moving web wherein the charged toner particles are coated on the web by an electrically biased deposition roller. A preferred system for carrying out this coating process is described copending U.S. Utility patent application Ser. No. 10/881,637, filed Jun. 30, 2004, titled "DRYING PROCESS FOR TONER PARTICLES USEFUL IN ELECTROGRAPHY." An alternative preferred system comprises using extrusion techniques to help transfer toner particles, which may or may not be charged at this stage, from a reaction solvent onto a substrate surface. A relatively thin coating of extruded particles is formed on the surface as a consequence. Because the resultant coating has a relatively large drying surface area per gram of particle incorporated into the coating, drying can occur relatively quickly under moderate temperature and pressure conditions. A preferred system for carrying out this drying process is described in copending U.S. Utility patent application Ser. No. 10/880,799, filed Jun. 30, 2004, titled "EXTRUSION DRYING PROCESS FOR TONER PARTICLES USEFUL IN ELECTROGRAPHY."

The coated toner particles can optionally be squeezed to eliminate excess reaction solvent by passing the coated web between at least one pair of calendaring rollers. The calendaring rollers preferably can be provided with a slight bias that is higher than the deposition roller applied to keep the charged toner particles from transferring off the moving web. Downstream from the coating station components, the moving web preferably passes through a drying station, such as an oven, in order to remove the remaining reaction solvent to the desired degree. Although drying temperatures may vary, drying preferably occurs at a web temperature that is at least about 5° C. and more preferably at least about 10° C., below the effective $T_g$ of the toner particles. After emerging from oven, the dried toner particles on the moving web are preferably passed through a deionizer unit to help eliminate triboelectric charging, and are then gently removed from the moving web (such as by scraping with a plastic blade) and deposited into a collection device at a particle removal station.

The resulting dry toner particle composition is readily dispersed in a carrier liquid. While not being bound by theory, it is believed that the drying process removes undesired impurities and charged component, such as undesired counterions, that adversely affect the viscosity, stability and imaging properties of the toner particles when provided in a liquid toner composition. Additionally, the dry toner particles are readily and stably dispersed in the carrier liquid. While not being bound by theory, it is believed that this dispersibility is due to the amphipathic nature of the binder polymer, in combination with the elimination of undesired components in the drying process.

In a preferred embodiment of the present invention, a "just in time" supply process is provided using the liquid toner process described herein, wherein the dry toner particle composition is stored at or near the manufacturing site, and dispersed in a carrier liquid as described herein only upon receipt of an order for liquid toner from a customer of the manufacturer. In another embodiment a supply process is provided wherein the dry toner particle composition is stored at or near the manufacturing site, and dispersed in a hydrocarbon carrier liquid as described herein only upon projection of near term (i.e. within 5 days) or imminent need of shipping of liquid toner from the manufacturing site. In both of these embodiments, advantages are realized in storage stability, volume of storage required, reduced flammability of the stored intermediate material, and the ability to easily premix dry toners to average out batch variations, thereby providing superior lot-to-lot consistency.

The toner compositions as described herein are highly useful in electrophotographic and electrographic processes. In electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention can be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

While the electrostatic charge of either the toner particles or photoreceptive element can be either positive or negative, electrophotography as employed in the present invention is preferably carried out by dissipating charge on a positively charged photoreceptive element. A positively-charged toner is then applied to the regions in which the positive charge was dissipated using a liquid toner development technique.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film can be coated or primed, e.g. to promote toner adhesion.

In electrophotographic processes, the toner composition preferably is provided at a solids content of about 1-30% (w/w). In electrostatic processes, the toner composition preferably is provided at a solids content of 3-15% (w/w).

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLES

Glossary of Chemical Abbreviations

The following abbreviations are used in the examples that follow:

AAD: Acrylamide (Sigma-Aldrich, Steiheim, Germany)

DBTDL: Dibutyl tin dilaurate (a catalyst available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

V-601: Dimethyl 2,2'-azobisisobutyrate (an initiator available as V-601 from WAKO Chemicals U.S.A., Richmond, Va.)

Zirconium HEX-CEM: metal soap, zirconium tetraoctoate (available from OMG Chemical Company, Cleveland, Ohio)

Test Methods

Percent Solids

In the following toner composition examples, percent solids of the graft stabilizer solutions and the organosol, the liquid toner dispersions, and dry toner determined thermogravimetrically by drying in an aluminum weighing pan an originally-weighed sample at 160° C. for two hours for graft stabilizer and three hours for organosol or liquid toner dispersions, weighing the dried sample, and calculating the percentage ratio of the dried sample weight to the original sample weight, after accounting for the weight of the aluminum weighing pan. Approximately two grams of sample were used in each determination of percent solids using this thermogravimetric method.

Molecular Weight

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using a Hewlett Packard Series II 1190 Liquid Chromatograph made by Agilent Industries (formerly Hewlett Packard, Palo Alto, Calif.) (using software HPLC Chemstation Rev A.02.02 1991-1993 395). Tetrahydrofuran was used as the carrier solvent. The three columns used in the Liquid Chromatograph were Jordi Gel Columns (DVB 1000A, and DVB1000A and DVB100000A; Jordi Associates, Inc., Bellingham, Mass.). Absolute weight average molecular weight were determined using a Dawn DSP-F light scattering detector (software by Astra v.4.73.04 1994-1999) (Wyatt Technology Corp., Santa Barbara, Calif.), while polydispersity was evaluated by ratioing the measured weight average molecular weight to a value of number average molecular weight determined with an Optilab DSP Interferometric refractometer detector (Wyatt Technology Corp., Santa Barbara, Calif.).

Particle Size

The organosol (and liquid ink) particle size distributions were determined using a Horiba LA-920 laser diffraction particle size analyzer (commercially obtained from Horiba Instruments, Inc, Irvine, Calif.) using Norpar™ 12 fluid that contains 0.1% Aerosol OT (dioctyl sodium sulfosuccinate, sodium salt, Fisher Scientific, Fairlawn, N.J.) surfactant.

The dry toner particle size distributions were determined using a Horiba LA-900 laser diffraction particle size analyzer (commercially obtained from Horiba Instruments, Inc, Irvine, Calif.) using de-ionized water that contains 0.1% Triton X-100 surfactant (available from Union Carbide Chemicals and Plastics, Inc., Danbury, Conn.).

Prior to the measurements, samples were pre-diluted to approximately 1% by the solvent (i.e., Norpar™ 12 or water). Liquid toner samples were sonicated for 6 minutes in a Probe VirSonic sonicator (Model-550 by The VirTis Company, Inc., Gardiner, N.Y.). Dry toner samples were sonicated in water for 20 seconds using a Direct Tip Probe VirSonic sonicator (Model-600 by The VirTis Company, Inc., Gardiner, N.Y.). In both procedures, the samples were diluted by approximately 1/500 by volume during the measurements. Sonication on the Horiba LA-920 was operated at 150 watts and 20 kHz. The particle size was expressed on a number-average ($D_n$) basis in order to provide an indication of the fundamental (primary) particle size, or was expressed on a volume-average ($D_v$) basis in order to provide an indication of the size of the coalesced, agglomerated primary particles.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 5° C. for 1-2 hours at 6,000 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, Inc., Hopkinton, Mass.). Unlike electrokinetic measurements based upon microelectrophoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counterions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

Glass Transition Temperature

Thermal transition data for synthesized TM was collected using a TA Instruments Model 2929 Differential Scanning Calorimeter (DSC) (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5-10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value—values are reported from either the third or fourth heat ramp.

Q/M

The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 1 hour at 160° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

Viscosity

Viscosity of the liquid inks was measured using a Brookfield viscometer (Model LVT, Brookfield Engineering Laboratories, Inc, Stoughton, Mass.).

Toner Drying Procedure

For some examples below, dry toner was prepared from a liquid toner using a Lab Coater (available from T.H. Dixon & Co. Ltd., Hertfordshire, England) equipped with a SENTRY™ (available from SIMCO Industrial Static Control, Bloomington, Minn.) ionizing air blower. The dry toner preparation method summarized below is disclosed in co-pending U.S. Utility patent application Ser. No. 10/881,637, filed Jun. 30, 2004, which is hereby incorporated by reference.

The coating apparatus includes coating station at which the liquid ink is coated onto surface of a moving web. The coating station includes a reservoir containing the charged toner particles dispersed in the liquid carrier (liquid ink). The coating station also includes an electrically biased deposition roller and calendar rollers. The deposition roller is at least partially submerged in the reservoir containing the liquid ink and may be made to contact or form a gapped nip with the moving web. In this apparatus, the deposition roller has a diameter of 0.89 inches (2.3 cm) and operates at a speed of 60 rpm (corresponding to a surface speed of 2.8 inches/s (7.1 cm/s)) when the web is moving at a speed of 5 feet/min.

The moving web onto which the particles are coated is an aluminized polyester film composite in which an approximately 0.1 μm (1000 Å) thick layer of aluminum is formed on an approximately 4.0 mil thick (100 μm) polyester substrate.

The deposition roller is provided with an electrical bias and is rotating in the liquid ink reservoir. The movement of the biased (100V) deposition roller picks up the positively charged toner particles, which are electroplated onto the web, which is preferably grounded. Electrical charge characteristics of the toner particles are used to help plate the particles from the reservoir onto the moving web surface, where the transferred particles are more easily and effectively dried.

The plated liquid ink particles are squeezed to eliminate excess carrier liquid by passing the plated web between at least one pair of calendaring rollers. The calendaring rollers have a slight bias that is higher than the deposition roller applied to keep the charged ink particles from transferring off the moving web.

Downstream from the coating station components, the moving web passes through a drying station in order to remove the remaining liquid carrier to the desired degree. Most commonly, the toner particles may be deemed to be dry when the particles can contain less than about 20 weight percent, preferably less than about 10 weight percent.

The drying station is an oven having a generally linear path along which the moving web travels. The liquid ink particles to be dried travel a 20 foot long web path through an oven maintained at 50° C. at a web speed of 5 feet per minute. The average coating thickness of particles on web is about 2 to about 10 times the average particle diameter of the toner particles.

Although drying temperatures may vary, drying occurs at a temperature that is at least 5° C., below the effective $T_g$ of the liquid toner. The temperature of 50° C. is used for liquid inks that have a $T_g$ of 65° C.

After emerging from the oven, the dried toner particles on the moving web are passed through a deionizer unit to help eliminate triboelectric charging. The dried toner particles are then gently scraped from the moving web by a plastic blade into a collection device at a particle removal station.

Print Testing

In the following examples, toner was printed onto final image receptors using the following methodology:

A light-sensitive temporary image receptor (organic photoreceptor or "OPC") was charged with a uniform positive charge of approximately 850 volts. The positively charged surface of the OPC was image-wise irradiated with a scanning infrared laser module in order to reduce the charge wherever the laser struck the surface. Typical charge-reduced values were between 50 volts and 100 volts.

A developer apparatus was then utilized to apply the toner particles to the OPC surface. The developer apparatus included the following elements: liquid toner, a conductive rubber developer roller in contact with the OPC, an insulative foam cleaning roller in contact with the developer roller surface, a conductive deposition roller, a conductive metering roll in contact with the developer roller, and an insulative foam ink pumping roller. The contact area between the developer roller and the OPC is referred to as the "developing nip." The conductive deposition roller was positioned with its roller axis parallel to the developer roller axis and its surface arranged to be approximately 150 microns from the surface of the developer roller, thereby forming a deposition gap.

During development, the ink pumping roller supplied liquid ink to the gap between the deposition roller and the developer roller. A toner film was initially plated to the developer roller surface by applying a voltage of approximately 600 volts to the developer roller and applying a voltage of approximately 800 volts to both the deposition and metering rollers. The 200 volt difference between the developer and deposition roller caused the positively charged toner particles to migrate in the deposition nip to the surface of the developer roller. The metering roller, which is biased to approximately 800 volts, removed excess liquid from the developer roller surface.

The surface of the developer roller now contained a uniformly thick layer of toner at approximately 25% (w/w) solids. As this toner layer passed through the developing nip, toner was transferred from the developer roller to the latent image areas. The approximate 500 volt difference between the developer roller and the latent image area caused the positively charged toner particles to develop to the OPC surface. At the exit of the developing nip, the OPC contained a toner image and the developer roller contained a negative of that toner image which was then cleaned from the developer roller surface by the rotating foam cleaning roller.

The developed image on the OPC was subsequently electrostatically transferred to an Intermediate Transfer Belt (ITB) with an electrical bias in the range of −800 to −2000 volts applied to a conductive rubber roller pressing the ITB to the OPC surface. Transfer to the final image receptor was accomplished with electrostatically-assisted offset transfer by forcibly applying a conductive, biased rubber transfer roller behind the image receptor, pressing the imaged ITB between the final image receptor and a grounded, conductive metal transfer backup roller. The transfer roller is typically biased in the range of −1200 to −3000 volts.

Optical Density and Color Purity

To measure optical density and color purity a GRETAG SPM 50 LT meter was used. The meter is made by Gretag Limited, CH-8105 Regensdort, Switzerland. The meter has several different functions through different modes of operations, selected through different buttons and switches. When a function (optical density, for example) is selected, the measuring orifice of the meter is placed on a background, or non-imaged portion of the imaged substrate in order to "zero"

it. It is then placed on the designated color patch and the measurement button is activated. The optical densities of the various color components of the color patch (in this case, Cyan (C), Magenta (M), Yellow (Y), and Black (K)) will then displayed on the screen of the meter. The value of each specific component is then used as the optical density for that component of the color patch. For instance, where a color patch is only cyan, the optical density reading may be listed as simply the value on the screen for C.

Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/EMA-TMI (97/3-4.7% w/w) is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97/3-4.7//100% w/w) is made by copolymerizing the designated graft stabilizer (TCHMA/HEMA-TMI (97/3-4.7% wlw)) (S portion or shell) with the designated core monomer EMA (D portion or core, 100% EMA) at a specified ratio of D/S (core/shell) determined by the relative weights reported in the examples.

Graft Stabilizer Preparations

Example 1

A 190 liter reactor equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 88.45 kg of Norpar™ 12 fluid, by vacuum. The vacuum was then broken and a flow of 28.32 liter/hr of nitrogen applied and the agitation is started at 70 RPM. Next, 30.12 kg of TCHMA was added and the container rinsed with 1.22 kg of Norpar™ 12 fluid and 0.95 kg of 98% (w/w) HEMA was added and the container rinsed with 0.62 kg of Norpar™ 12 fluid. Finally, 0.39 kg of V-601 was added and the container rinsed with 0.091 kg of Norpar™ 12 fluid. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 28.32 liter/hr was applied. Agitation was resumed at 70 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.05 kg of 95% (w/w) DBTDL was added to the mixture using 0.62 kg of Norpar™ 12 fluid to rinse container, followed by 1.47 kg of TMI. The TMI was added continuously over the course of approximately 5 minutes while stirring the reaction mixture and the container was rinsed with 0.64 kg of Norpar™ 12 fluid. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.0% (w/w) using the drying method described above. Subsequent determination of molecular weight was made using the GPC method described above; the copolymer had a $M_w$ of 289,800 and $M_w/M_n$ of 2.44 based on two independent measurements. The product is a copolymer of TCHMA and HEMA with a TMI grafting site and is designed herein as TCHMA/HEMA-TMI (97/3-4.7% w/w) and can be used to make an organosol. The glass transition temperature was measured using DSC, as described above. The shell co-polymer had a $T_g$ of 115° C.

Example 2

A 190 liter reactor equipped with a condenser, a thermocouple connected to a digital temperature controller, a nitrogen inlet tube connected to a source of dry nitrogen, and a mixer was charged with a mixture of 91.6 kg of Norpar™ 12 fluid, 30.1 kg of TCHMA, 0.95 kg of 98% (w/w) HEMA, and 0.39 kg of V-601. While stirring the mixture, the reactor was purged with dry nitrogen for 30 minutes at flow rate of approximately 2 liters/minute, and then the nitrogen flow rate was reduced to approximately 0.5 liters/min. The mixture was heated to 75° C. for 4 hours. The conversion was quantitative.

The mixture was heated to 100° C. for 1 hour to destroy any residual V-601 and then was cooled back to 70° C. The nitrogen inlet tube was then removed and 0.05 kg of 95% (w/w) DBTDL was added to the mixture. Next, 1.47 kg of TMI was gradually added over the course of approximately 5 minutes into the continuously stirred reaction mixture. The mixture was allowed to react at 70° C. for 2 hours, at which time the conversion was quantitative.

The mixture was then cooled to room temperature to produce a viscous, transparent liquid containing no visible insoluble mater. The percent solids of the liquid mixture was determined to be 26.2% (w/w) using the drying method described above. Subsequent determination of molecular weight was made using the GPC method described above: the copolymer had an $M_w$ of 251,300 Da and $M_w/M_n$ of 2.8 based on two independent measurements. The product is a copolymer of TCHMA and HEMA with a TMI grafting site attached to the HEMA and is designed herein as TCHMA/HEMA-TMI (97/3-4.7% w/w) and can be used to make an organosol. The glass transition temperature was measured using DSC, as described above. The shell co-polymer had a $T_g$ of 120° C.

TABLE 1

Graft Stabilizers

| Example Number | Graft Stabilizer Compositions (% w/w) | Solids (% w/w) | Molecular Weight $M_w$ | $M_w/M_n$ |
|---|---|---|---|---|
| 1 | TCHMA/HEMA-TMI (97/3-4.7% w/w) | 26.0 | 289,800 | 2.44 |
| 2 | TCHMA/HEMA-TMI (97/3-4.7% w/w) | 26.2 | 251,300 | 2.8 |

Orianosol Preparation

Example 3

This example illustrates the use of the graft stabilizer in Example 2 to prepare an organosol with a D/S ratio of 9/1. A 5000 ml, 3-neck round flask equipped with a condenser, a thermocouple connected to a digital temperature controller, a nitrogen inlet tube connected to a source of dry nitrogen and a mechanical stirrer, was charged with a mixture of 2614 g of Norpar™ 12, 267.18 g of the graft stabilizer mixture from Example 2 @26.2% (w/w) polymer solids, 560 g of EMA, 49.63 g of AAD, and 9.45 g of V-601 were combined. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

Approximately 350 g of n-heptane was added to the cooled organosol. The resulting mixture was stripped of residual monomer using a rotary evaporator equipped with a dry ice/acetone condenser and operating at a temperature of 90° C. and using a vacuum of approximately 15 mm Hg. The stripped organosol was cooled to room temperature, yielding an opaque white dispersion.

This organosol was designed (TCHMA/HEMA-TMI//EMA/AAD) (97/3-4.7//91.9/8.1% w/w) D/S 9/1 and can be used to prepare toner formulations. The percent solids of the organosol dispersion after stripping was determined to be 15.8% (w/w) using the drying method described above. Subsequent determination of average particles size was made using the laser diffraction method described above; the organosol had a volume average diameter 53.3 μm. The glass transition temperature of the organosol polymer was measured using DSC, as described above, was 65° C.

Example 4

A 2120 liter reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 689 kg of Norpar™ 12 fluid and 43.0 kg of the graft stabilizer mixture from Example 1 @25.4% (w/w) polymer solids along with an additional 4.3 kg of Norpar™ 12 fluid to rinse the pump. Agitation was then turned on at a rate of 65 RPM, and temperature was check to ensure maintenance at ambient. Next, 92 kg of EMA was added along with 12.9 kg of Norpar™ 12 fluid for rinsing the pump. Finally, 1.0 kg of V-601 was added, along with 4.3 kg of Norpar™ 12 fluid to rinse the container. A 40 torr vacuum was applied for 10 minutes and then broken by a nitrogen blanket. A second vacuum was pulled at 40 torr for an additional 10 minutes, and then agitation stopped to verify that no bubbles were coming out of the solution. The vacuum was then broken with a nitrogen blanket and a light flow of nitrogen of 14.2 liter/min was applied. Agitation of 75 RPM was resumed and the temperature of the reactor was heated to 75° C. and maintained for 5 hours. The conversion was quantitative.

The resulting mixture was stripped of residual monomer by adding 86.2 kg of n-heptane and 172.4 kg of Norpar™ 12 fluid and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 360.6 kg of distillate was collected. A second strip was performed, following the above procedure and 281.7 kg of distillate was collected. The vacuum was then broken and the stripped organosol was cooled to room temperature, yielding an opaque white dispersion.

This organosol is designed TCHMA/HEMA-TMI//EMA (97/3-4.7//100% w/w). The percent solid of the organosol dispersion after stripping was determined as 13.3% (w/w) by the drying method described above. Subsequent determination of average particles size was made using the light scattering method described above. The organosol particle had a volume average diameter of 42.3 μm. The glass transition temperature of the organosol polymer was measured using DSC, as described above, was 62.7° C.

TABLE 2

Organosols

| Example Number | Organosol Compositions (% w/w) (Core/shell ("D/S") ratio) | $T_g$(° C.) | Particle Size (μM) |
|---|---|---|---|
| 3 | TCHMA/HEMA-TMI//EMA/AAD (97/3-4.7//92/8), D/S 9 | 65 | 53.3 |
| 4 | TCHMA/HEMA-TMI//EMA (97/3-4.7//100), D/S 8 | 62.7 | 42.3 |

Preparation of Liquid Inks and Subsequent Preparation of Dry Toners

Example 5

This example illustrates the use of the organosol in Example 3 to prepare a liquid toner and, subsequently, a dry toner. 1790 g of organosol @15.8% (w/w) solids in Norpar™ 12 was combined with 358 g of Norpar™ 12, 47 g of Black pigment (Aztech EK8200, Magruder Color Company, Tucson, Ariz.) and 4.43 g of 26.61% (w/w) Zirconium HEX-CEM solution. This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media (available from Morimura Bros. (USA) Inc., Torrence, Calif.). The mill was operated at 2000 RPM with chilled water circulating through the jacket of the milling chamber temperature at 21° C. Milling time was 61 minutes. The percent solids of the toner concentrate was determined to be 15.5% (w/w) using the drying method described above. Average particle size was made using the Horiba LA-920 laser diffraction method described above.

Volume Mean Particle Size: 6.21 micron
Q/M: 168 μC/g
Bulk Conductivity: 439 picoMhos/cm
Percent Free Phase Conductivity: 0.88%
Dynamic Mobility: 8.23E-11 ($m^2$/Vsec)

Dry Toner:

About 1540 g of the liquid ink in this example was dried using the toner drying procedure described above. The percent solids of the dried toner powders were determined using the drying method described above. Table 3 summarizes the percent solids of the dried toners for this example.

Example 6

114.04 kg of organosol from example 4 @13.30% (w/w) solids in Norpar™ 12 were combined with 22.58 kg of Norpar™ 12, 3.03 kg of Pigment Black EK8200 (Aztech Company, Tucson Ariz.) and 352.7 g of 25.8% (w/w) Zirconium HEX-CEM solution. This mixture was then milled in a Hockmeyer HSD Immersion Mill (Model HM-5, Hockmeyer Equipment Corp. Elizabeth City, N.C.) charged with 15 kg of 0.8 mm diameter Yttrium Stabilized Ceramic Media (available from Morimura Bros., (USA) Inc., Torrence, Calif.). The mill was operated at 1,364 RPM for 1 minute with hot water circulating through the jacket of the milling chamber at 80° C. and an additional 94 minutes at 45° C.

A 13% (w/w) solids toner concentrate exhibited the following properties as determined using the test methods described above:

Volume Mean Particle Size: 5.0 micron

Q/M: 181 μC/g

Bulk Conductivity: 340 picoMhos/cm

Percent Free Phase Conductivity: 1.72%

Dry Toner:

About 1540 g of the liquid ink in this example was dried using the toner drying procedure described above. The percent solids of the dried toner powders were determined using the drying method described above. Table 3 summarizes the percent solids of the dried toners for this example.

TABLE 3

Percent solid of the dried organosol toners

| | Example # | |
|---|---|---|
| | 5 | 6 |
| Percent Solids (% w/w) | 97 | 97 |

Preparation of Re-dispersed Inks

Example 7

39.6 g of the dried toner from example 5 were combined with 290.4 g of Norpar™ 12 in a 32 oz. bottle. The mixture in the bottle was then hand-shaken for about two minutes followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, ink viscosity and the functional printing were measured. Table 4 summarizes the test results of this example compared with the same test results for the original liquid ink of example 5.

Example 8

45.5 g of the dried toner from example 6 were combined with 304.5 g of Norpar™ 12 in a 32 oz. bottle. The mixture in the bottle was then hand-shaken for about two minutes followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, ink viscosity and the functional printing were measured. Table 4 summarizes the test results of this example compared with the same test results for the original liquid ink of example 6.

Example 9

0.475 g of 25.8% (w/w) Zirconium HEX-CEM solution was added to 330 g of example 8. The mixture in the bottle was then hand-shaken for about two minutes followed by 10 minutes of sonication in a Bransonic 32 Ultrasonic cleaner (Branson Cleaning Equipment Co., Shelton, Conn.). Using the test procedures described above, the particle size, conductivity, free phase conductivity (FPC), Q/M, ink viscosity and the functional printing were measured. Table 4 summarizes the test results of this example compared with the same test results for the original liquid ink of examples 6 and 8.

Example 10

4 g of dried toners in example 6 were combined with 36 g of Dow Coming® 200, (2 cs) silicone fluid (Dow Corning Co, Midland, Mich.) in a 16 oz bottle. The mixture in the bottle was then hand-shaken for about two minutes followed by sonicating for 6 minutes in a Direct Tip Probe VirSonic sonicator (Model-550 by The VirTis Company, Inc., Gardiner, N.Y.). Using the test procedures described above, the particle size, conductivity, free phase conductivity (FPC), Q/M, ink viscosity and the functional printing were measured. Table 4 summarizes the test results for this example.

Example 11

52.9 g of dried toners in example 6 were combined with 348 g of Eurosupreme synthetic dielectric fluid (Commonwelth Oil, Ontario, Canada) in a 64 oz bottle. The mixture in the bottle was then hand-shaken for about two minutes followed by 10 minutes of sonication in a Bransonic 32 Ultrasonic cleaner (Branson Cleaning Equipment Co., Shelton, Conn.). Using the test procedure described above, the conductivity that directly reflected the charge levels of the toner particles was measured.

A 13.2% (w/w) solids toner concentrate exhibited the following properties as determined using the test methods described above:

Volume Mean Particle Size: 3.91micron

Q/M: 198 μC/g

Bulk Conductivity: 177 picoMhos/cm

Percent Free Phase Conductivity: 3.19%

TABLE 4

Analytical test results of the original and re-dispersed inks

| Example | Carrier Liquid | CCA (μg/g) | Solid (% w/w) | Conductivity (pMho/cm) | Particle Size Dv (μ) | Particle Size Dn (μ) | % FPC | Q/M (μC/g) | Viscosity (cps) |
|---|---|---|---|---|---|---|---|---|---|
| 5 | Norpar ™ 12 | 25 | 13.5 | 231 | 6.86 | 1.3 | — | 150 | 60 |
| Comparative 6 | Norpar ™ 12 | 30 | 13 | 340 | 5 | 1.3 | 1.72 | 181 | 42.5 |
| Comparative 7 | Norpar ™ 12 | | 12 | 127 | 5.98 | 1.15 | — | 105 | 11 |

TABLE 4-continued

Analytical test results of the original and re-dispersed inks

| Example | Carrier Liquid | CCA (μg/g) | Solid (% w/w) | Conductivity (pMho/cm) | Particle Size Dv (μ) | Particle Size Dn (μ) | % FPC | Q/M (μC/g) | Viscosity (cps) |
|---|---|---|---|---|---|---|---|---|---|
| 8 | Norpar ™ 12 | | 13 | 151 | 4.9 | 1.34 | 1.78 | 87 | 30 |
| 9 | Norpar ™ 12 + Zirconium HEX-CEM | +20 | — | 330 | — | — | — | — | 25 |
| 10 | Silicone Fluid | — | 10 | 54 | 11.27 | 2 | 1.57 | 75 | 25 |
| 11 | Eurosupreme ™ | — | 13.2 | 177 | 3.91 | — | 3.19 | 198 | — |

Print Testing

Using the test procedures described above, evaluation of the re-dispersed inks in Examples 7, 8, 9, and 11 as well as the original inks from Examples 5 and 6 were carried out using Laser 1000 paper (Georgia-Pacific, Atlanta, Ga.). The redispersed inks were print tested immediately after being redispersed, without additional agitation, mixing, or blending. A printing device for testing the print quality of Example 10 was not available. After the inks were print tested, they were observed for general appearance of the image (image quality), and the optical density ("OD") of the solid area was measured as described above. Table 7 summarizes the print test results for the original inks before drying to obtain the dried powders and the re-dispersed inks from the dried powders. The visual observations made in Table 7 are described in Table 6, below.

TABLE 6

Visual assessment of the printed samples

| Print | Commentary |
|---|---|
| Excellent | No microvoids in the image. Image appears smooth and sharp |
| Good | A few microvoids on solid area. Image still appears smooth and sharp |
| Fair | Quite a few microvoids. Image appears papery |
| Poor | A lot of microvoids mingle with flow patterns in the image |

TABLE 7

Summary of functional printing test results

| Example | Print Quality | Flow pattern | Optical Density |
|---|---|---|---|
| 5 (Comparative) | Excellent | No | 1.32 |
| 7 | Excellent | No | 1.34 |
| 6 (Comparative) | Good | Yes | 1.28 |
| 8 | Poor | Yes | 1.17 |
| 9 | Good | No | 1.36 |
| 10 | NA | NA | NA |
| 11 | Good–Fair | No | 1.07 |

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A method of preparing a liquid toner composition for use within an electrophotographic printing apparatus, comprising the steps of:

a) preparing a polymeric binder comprising at least one amphipathic copolymer comprising one or more S material portions and one or more D material portions in a reaction solvent, wherein the reaction solvent comprises less than about 10% aromatic components by weight and has a Kauri-Butanol number less than about 30 mL;

b) formulating toner particles comprising the polymeric binder of step a) and a visual enhancement additive in the reaction solvent;

c) drying a plurality of toner particles as formulated in step b) to provide a dry toner particle composition; and d) redispersing the dry toner particle composition of step c) in a carrier liquid having a Kauri-Butanol number less than about 30 mL to form a liquid electrographic toner composition;

wherein the step of redispersing the dry toner particle composition of step d) is performed within the electrophotographic printing apparatus.

2. The method of claim 1, wherein the carrier liquid is substantially the same as the reaction solvent.

3. The method of claim 1, wherein the carrier liquid is different from the reaction solvent.

4. The method of claim 1, wherein the carrier liquid has a normal boiling point above about 240° C.

5. The method of claim 1, wherein the reaction solvent is a hydrocarbon solvent.

6. The method of claim 1, wherein the reaction solvent has a normal boiling point below about 100° C.).

7. The method of claim 1, wherein the liquid carrier in which the dry toner particle is redispersed is a silicone fluid.

8. The method of claim 1, wherein the dry toner particle composition comprises a positive charge director.

9. The method of claim 1, wherein the dry toner particle composition comprises a negative charge director.

10. The method of claim 1, wherein the dry toner particle composition is stored in the dry state for a period of at least about 3 weeks prior to redispersion in the carrier liquid.

11. The method of claim 1, wherein the S material portions comprise a plurality of anchoring groups, thereby providing an amphipathic copolymer having a plurality of links between the individual S material portions and the D material portions.

12. The method of claim 1, wherein the reaction solvent is selected from the group consisting of aliphatic hydrocarbons, cycloaliphatic hydrocarbons, halogenated hydrocarbons, branched paraffinic solvents, aliphatic hydrocarbon solvents, and mixtures thereof.

13. The method of claim 1, wherein the carrier liquid is selected from the group consisting of branched paraffinic solvents, aliphatic hydrocarbon solvents, and mixtures thereof.

14. The method of claim 1, wherein the step of redispersing the dry toner particle composition in a carrier liquid further comprises mixing the toner particles within the carrier liquid.

15. The method of claim 14, wherein the mixing of the toner particles within the carrier liquid comprises a continuous mixing process.

16. A method of printing at least one electrophotographic image with the liquid electrophotographic toner composition made by the method of claim 1.

17. A method of preparing a liquid electrophotographic toner composition within an electrophotographic printing apparatus, comprising the steps of:

a) providing a dry toner particle composition prepared by formulating toner particles comprising a polymeric binder having at least one amphipathic copolymer comprising one or more S material portions and one or more D material portions in a reaction solvent, wherein the reaction solvent comprises less than about 10% aromatic components by weight and has a Kauri-Butanol number less than about 30 mL, with a visual enhancement additive in the reaction solvent, then drying the toner particles; and b) redispersing the dry toner particle composition in a carrier liquid having a Kauri-Butanol number less than about 30 mL to form a liquid electrographic toner composition within an electrophotographic printing apparatus.

* * * * *